US008305317B2

(12) United States Patent
Vaillant et al.

(10) Patent No.: US 8,305,317 B2
(45) Date of Patent: Nov. 6, 2012

(54) METHOD FOR ADDRESSING AN LCD DISPLAY IN COLOR SEQUENTIAL MODE

(75) Inventors: Maxime Vaillant, Marseilles (FR); Patrick Rocca, Saint Hilaire de la Cote (FR); Hugues Lebrun, Coublevie (FR)

(73) Assignee: Thales, Neuilly sur Seine (FR)

( * ) Notice: Subject to any disclaimer, the term of this patent is extended or adjusted under 35 U.S.C. 154(b) by 641 days.

(21) Appl. No.: 12/520,621

(22) PCT Filed: Dec. 20, 2007

(86) PCT No.: PCT/EP2007/064301

§ 371 (c)(1),
(2), (4) Date: Aug. 19, 2009

(87) PCT Pub. No.: WO2008/077873

PCT Pub. Date: Jul. 3, 2008

(65) Prior Publication Data

US 2010/0019999 A1 Jan. 28, 2010

(30) Foreign Application Priority Data

Dec. 22, 2006 (FR) ..... 06 11257

(51) Int. Cl.
*G09G 3/36* (2006.01)

(52) U.S. Cl. ..... 345/88

(58) Field of Classification Search ..... 345/88
See application file for complete search history.

(56) References Cited

U.S. PATENT DOCUMENTS

| | | | | |
|---|---|---|---|---|
| 6,570,554 | B1 | 5/2003 | Makino et al. | |
| 2003/0020677 | A1 | 1/2003 | Nakano | |
| 2003/0132901 | A1 * | 7/2003 | Shimada | 345/87 |
| 2006/0152534 | A1 * | 7/2006 | Chang et al. | 345/690 |
| 2009/0146937 | A1 | 6/2009 | Lebrun et al. | |

FOREIGN PATENT DOCUMENTS

| | | |
|---|---|---|
| JP | 2004 333576 | 11/2004 |
| JP | 2004-333576 | * 11/2004 |

OTHER PUBLICATIONS

U.S. Appl. No. 12/063,359, filed Feb. 8, 2008, Lebrun, et al.
U.S. Appl. No. 12/096,381, filed Oct. 3, 2008, Lebrun, et al.

* cited by examiner

*Primary Examiner* — Quan-Zhen Wang
*Assistant Examiner* — Nelson D Runkle, III
(74) *Attorney, Agent, or Firm* — Oblon, Spivak, McClelland, Maier & Neustadt, L.L.P.

(57) ABSTRACT

In a method for addressing an LCD display in color sequential mode, the color frames of a received video sequence are rearranged to form a display sequence applied to the LCD display. The arrangement of the color frames in the display sequence is such that the succession of the colors of the color frames and/or the duration of the color frames is random. Such a method may find application to direct view screens.

13 Claims, 5 Drawing Sheets

METHOD FOR ADDRESSING AN LCD DISPLAY IN COLOR SEQUENTIAL MODE

FIELD OF THE INVENTION

The present invention relates to a liquid crystal display of the color sequential addressing type, and more particularly to a method for addressing such a display. It applies more particularly to the whole range of direct view screens, from cellular telephone screens to large-dimension screens for television.

BACKGROUND OF THE INVENTION

One advantage of displays of the color sequential type is the possibility to produce color display systems for direct-view screens without colored filters, that is to say without color information attached to a picture dot (pixel). Each picture dot is colorless and a lightbox is used which makes it possible successively to illuminate the display in the three primary colors, typically, in red, in green and in blue.

Addressing then comprises several color frames for each complete video frame. In the time of each color frame, all the pixels of the matrix are addressed to display the video information corresponding to the associated primary color, and the lightbox illuminates the display in the corresponding primary color.

A corresponding color sequence is illustrated in FIG. 1: In each frame, F1 for example, three color frames, red, green and blue, in the example $f_R$1, $f_G$1 and $f_B$1 respectively, follow one another. The red, green, blue color sequence is repeated periodically at the frequency of the complete video frames. In the example, the frame frequency is equal to 60 Hz giving a duration T0 of 16.667 ms for each video frame.

A known problem with these displays is the problem called "color break-up", due to the stabilization time of the liquid crystal, which results in a display defect that is perceptible to an observer's eye. Specifically, because of the ability of the eye to distinguish very rapid movements, it is capable of distinguishing the succession of the various color frames. Notably, an observer perceives color flickering that is particularly visible on a white picture when the screen operates at low frequency or when he moves his head in front of the screen. Although the eye accepts without too much trouble a complete refresh of the pictures at 50 Hz, a change in the colors at the frequency of 150 Hz can be detected in the observation situations as cited above.

The eye's perception of this display defect takes the form of a succession of colored bands or fringes, typically the succession of the primary colors, as illustrated schematically in FIG. 1, with a spatial frequency which depends on the refresh frequency of the picture. Therefore, in the example, the eye perceives a periodic succession of a red band, a green band and a blue band.

It will be noted here that, by convention, the red is depicted in white dots on a black background, the green in oblique black dashed lines on a white background and the blue by a grid of black lines on a white background.

To solve this display defect problem due to the periodic succession of the color frames, an effort is usually made to increase the frequency of the video frames, in particular to double it. The color break-up effect is lessened. Nevertheless it still remains clearly visible, because it is not possible to refresh the picture at too high a frequency for reasons of technological compatibility with active matrix screens. Also the picture frequency remains well below the threshold defining the limit of perception of the phenomenon, according to the visual acuity of a standard observer.

SUMMARY OF THE INVENTION

In the invention, an effort has been made to solve this problem in another way, by proposing particular temporal and/or spatial arrangements of the color frames, in order to generate color sequences presented to the display, which are such that the succession of colors according to these arrangements becomes imperceptible, or virtually imperceptible to the eye. These arrangements may advantageously be combined with arrangements of the lighting powers emitted in the successive phases of illuminating the display.

The invention relates to a method for addressing a color sequential liquid crystal display, based on a video sequence of successive color frames, which comprises a step of random or pseudo-random arrangement of said color frames of said video sequence, in order to provide a display sequence of color frames to be applied to said display, said random arrangement comprising a random or pseudo-random arrangement of the order of display of said color frames, and/or a random or pseudo-random allocation of duration of each of said color frames.

According to the invention, said random arrangement is such that said display sequence comprises a succession of packets of n color frames, n being an integer at least equal to 3, each packet being associated with a pair of primary colors, comprising a first primary color and a second primary color, the odd-numbered color frames in a packet being color frames corresponding to said first color, the even-numbered color frames in the packet being color frames corresponding to said second color.

The level of light power emitted in the illumination phase of a color frame is advantageously random. In a variant, the level of light power of each color frame is such that the lighting power reconstituted on the display corresponds to an achromatic white.

The invention also relates to a liquid crystal display of the color sequential addressing type comprising an addressing device using an addressing method according to the invention.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious aspects, all without departing from the invention.

Accordingly, the drawings and description thereof are to be regarded as illustrative in nature, and not as restrictive.

DETAILED DESCRIPTION OF PREFERRED EMBODIMENTS

As a preliminary, it should be noted that LCD displays use the additive system of three beams of primary colors that are bright red (or red) marked R, bright green (or green) marked G, and dark blue (or blue) marked B, in order to reconstitute a white light. These primary colors are represented in the figures, red R in white dashes on a black background, green G in black oblique dashed lines on a white background and blue B by a grid of black lines on a white background.

The addition of two primary colors gives a secondary color as follows:

Primary colors→Secondary color obtained

Blue B+Green G→Cyan blue, marked Bc

Blue B+Red R→Purple or magenta red, marked M

Blue B+Green G→Yellow, marked Y, and in the figures, cyan blue Bc is shown as dark gray, purple M as light gray and yellow Y as mid-gray.

Figure 3:
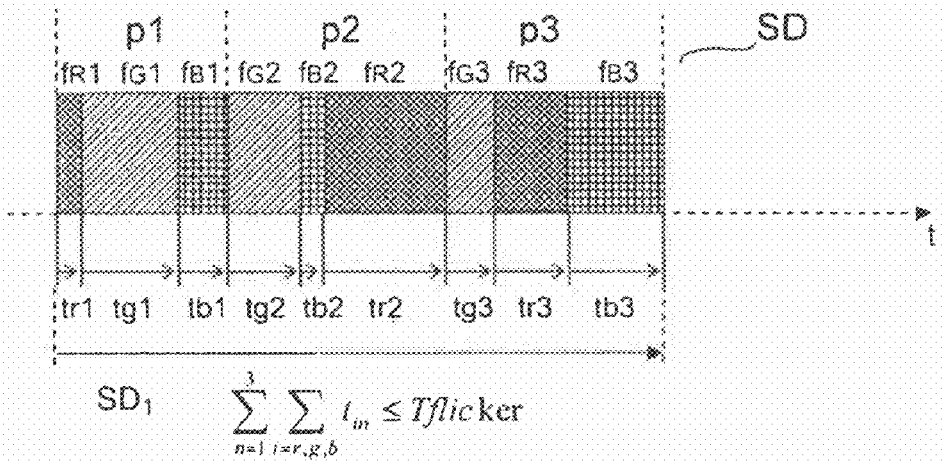
FIG. 3 illustrates a sequence of color frames formed by an addressing method according to the invention.
Figure 4:
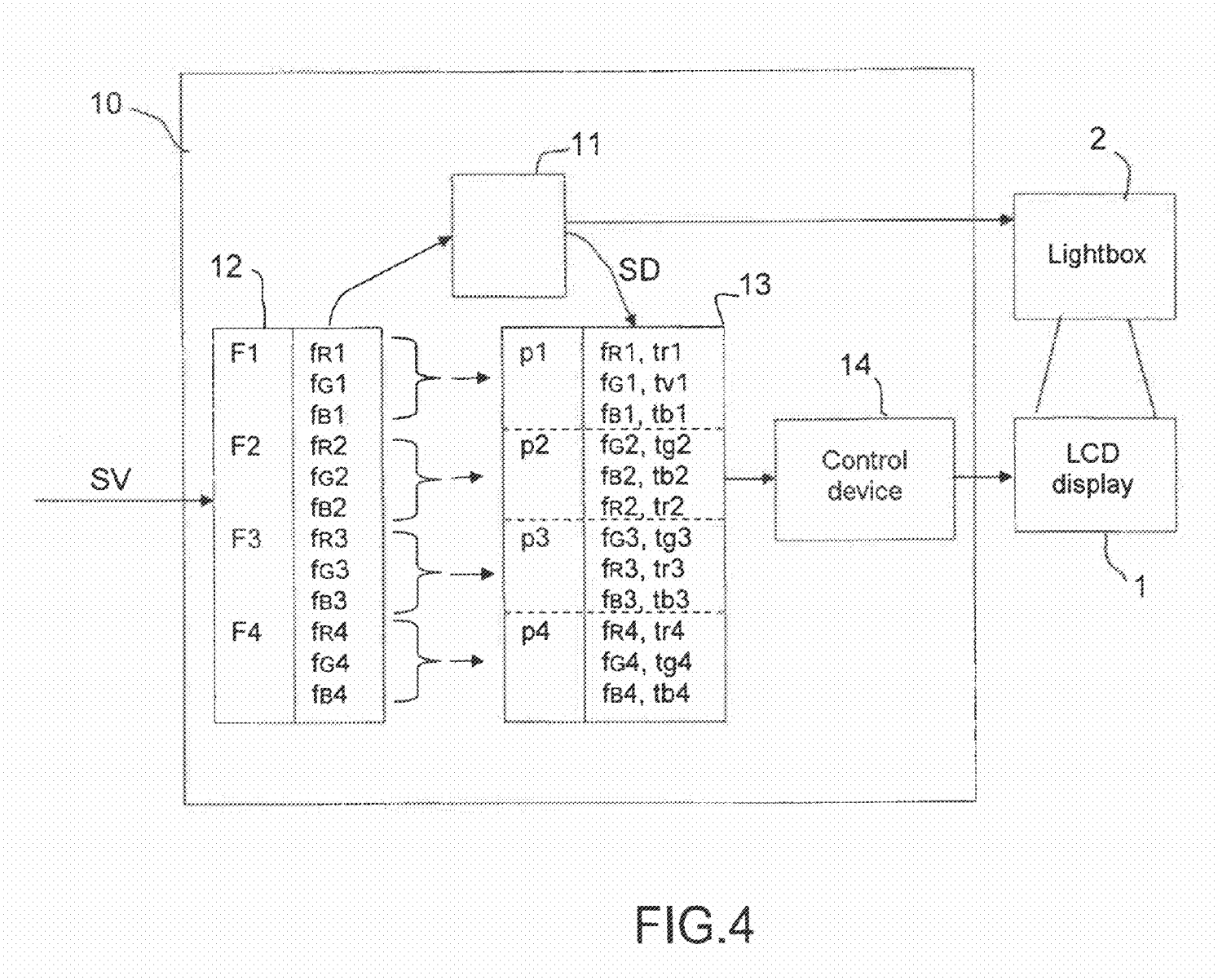
FIG. 4 illustrates a display with an addressing device for the use of a method according to the invention.

FIGS. 3 and 4 illustrate an addressing method according to the invention, wherein the color frames of a video sequence SV are arranged randomly or virtually randomly, in order to constitute a display sequence SD of color frames applied to a display 1. This random or pseudo-random arrangement according to the invention applies to the order of display of the color frames on the display 1, and/or the duration of each of the color frames.

As an example, the display sequence SD formed according to the invention comprises a sequence of color frames $f_R1$, $f_G1$, $f_B1$, $f_G2$, $f_B2$, $f_R2$, $f_G3$, $f_R3$, $f_B3$, corresponding to a random succession of the primary colors in the sequence R G B G B R G R B, each corresponding color frame having a specific duration, chosen randomly, in the example tr1, tg1, tb1, tg2, tb2, tr2, tg3, tr3, tb3 etc, respectively.

In a manner known in the prior art, a complete frame of a color video picture to be displayed comprises three successive color video frames, always in the same order, typically a red, then green, then blue video frame. An addressing device processes the complete video frames with their color video frames presented in order to the display. For each color video frame, the addressing device reads the corresponding data to be displayed in order to command the pixels of the matrix in an appropriate write phase, and the matrix is illuminated in the corresponding primary color.

In the invention, the display device arranges the color video frames of one or more complete video frames, in order to form a sequence SD of color frames in which the primary colors are presented randomly in sequence and/or in which the durations of the color frames are random.

Fk (k being an integer) depicts the complete video frames transmitted by an input signal of a video sequence SV, containing the pictures to be displayed. $f_R k$, $f_G k$, $f_B k$ depict the red, green, blue color video frames of a video frame Fk of the video sequence SV.

Therefore, as illustrated in FIG. 4 in correspondence with the example of the display sequence SD illustrated in FIG. 3, a display device according to the invention forms a display sequence SD applied to the display 1, based on color frames of the received video sequence. This formation of a display sequence SD according to the invention consists in presenting the color video frames in a random order and/or in allocating them a random frame time or duration.

In the example illustrated with reference to FIGS. 3 and 4, there is the combination of the two random processes: the order of the color frames and the frame time allocated to each color frame. With reference to this example and to these figures, the display sequence SD according to the invention may be achieved as described below.

A video signal to be displayed is received in the form of a video sequence SV of video frames. The display device 10 comprises means 11 for forming, based on the color frames of this video sequence SV, a display sequence SD of color frames, for example the sequence SD described in FIG. 3.

In one embodiment of the invention k successive video frames F1 to Fk (k being a nonzero whole number) of the sequence are stored for example in a buffer memory 12 supplied by the incoming signal SV, in order to allow the formation of a display sequence according to the invention. In the example illustrated in FIG. 4, the buffer memory is supplied by four successive video frames, F1 to F4 which comprise respectively the following color frames: $f_R1$, $f_G1$, $f_B1$ for F1, $f_R2$, $f_G2$, $f_B2$ for F2, $f_R3$, $f_G3$, $f_B3$ for F3, $f_R4$, $f_G4$, $f_B4$ for F4.

The display sequence SD may be formed gradually as the input buffer memory 12 is filled by the frames of the video sequence SV, and it may itself be stored gradually in a buffer memory 13 as illustrated or directly supply a control device 14 of the LCD display 1. The color frames of the display sequence SD are therefore successively displayed on the LCD display 1.

In parallel, the lightbox 2 is controlled synchronously in order to illuminate the LCD display in correspondence with the display of the current color frame of the sequence SD, during the frame time allocated to this color frame, which may be fixed or random depending on the implementation of the invention.

With reference to the formation of the display sequence of the color frames, it will be noted that, in the example illustrated in FIGS. 3 and 4, the order of the color frames is random for the duration of a complete video frame Fk. In other words, each packet of three color frames of the display sequence SD corresponds to the color frames of a video frame Fk of the video sequence SV, but presented in a random order relative to their natural order in the original video sequence SV, and/or each being associated with a random frame time. In this exemplary embodiment of the invention, the means 11 for forming the display sequence SD take the first complete video frame F1 of the video sequence SV stored in the buffer memory, and form a first packet p1 of the sequence SD by taking a random order of display of the three color frames $f_R1$, $f_G1$, $f_B1$ of this video frame F1; then the means 11 pass to the next complete video frame F2 in order to form a second packet p2 with its color frames $f_R2$, $f_G2$, $f_B2$, etc. and so on. The display sequence SD is therefore formed of the sequence of the packets p1, p2, etc.

The invention is not limited to this embodiment of a display sequence SD. More generally, the display sequence SD may be formed from color frames of one or more video frames Fk. Such embodiments of a display sequence SD based on the color frames of several frames F1 to Fk of an input video sequence SV are notably illustrated in FIGS. 5 and 6. In this case, the input buffer memory 12 will contain at least the k frames from which a sequence of packets of the display sequence will be formed.

In practice, the application of the invention must satisfy various requirements, in order to fully produce all its effects and not degrade the performance of the display. Notably, three requirements must be taken into account:

the duration of a color frame of the display sequence SD must be sufficiently short so as not to mark the eye of an observer in a durable manner.

the duration of a color frame of the display sequence SD must not be too short so as to be compatible with the performance of the liquid crystal on the active matrix. Notably it must be longer than the liquid crystal stabilization time of which a typical value is of the order of a millisecond.

the color balance must be preserved in order to obtain an achromatic white. Typically, this is obtained with a lighting power reconstituted on the display comprising 60% green, 20% red and 20% blue.

The first two requirements impose an interval of possible values for the color frame times, with a minimum value $T_{min}$ (second requirement) and a maximum value $T_{max}$ (first requirement). The last requirement involves not favoring one primary color relative to another for too long a time (perceptible to the eye).

To the extent that random frame times and/or sequences are allocated in which the colors are presented in a random order, so it is preferable to choose implementations of the invention comprising rules or requirements in order to form the display sequence SD. In other words, it is preferable in practice to use a pseudo-random arrangement which makes it possible both to remove the color break-up effect or to lessen the perception thereof very greatly and furthermore to maintain optimal performance for the display.

The implementation of the invention therefore assumes the application of strict random rules for selecting the colors and/or the frame times, which will give the mechanism for arranging the color frames of the received video sequence SV in order to form the display sequence SD according to the invention. The user may advantageously add to this mechanism a method of controlling the lightbox which illuminates the LCD display in each of the colors with respect to the current color frame displayed, according to which the lighting power emitted by this lightbox in each illumination phase, that is to say for each current color frame, is random. In a variant, the method of controlling the level of lighting power of the lightbox is such that the lighting power reconstituted on the display corresponds to an achromatic white.

Figure 5:
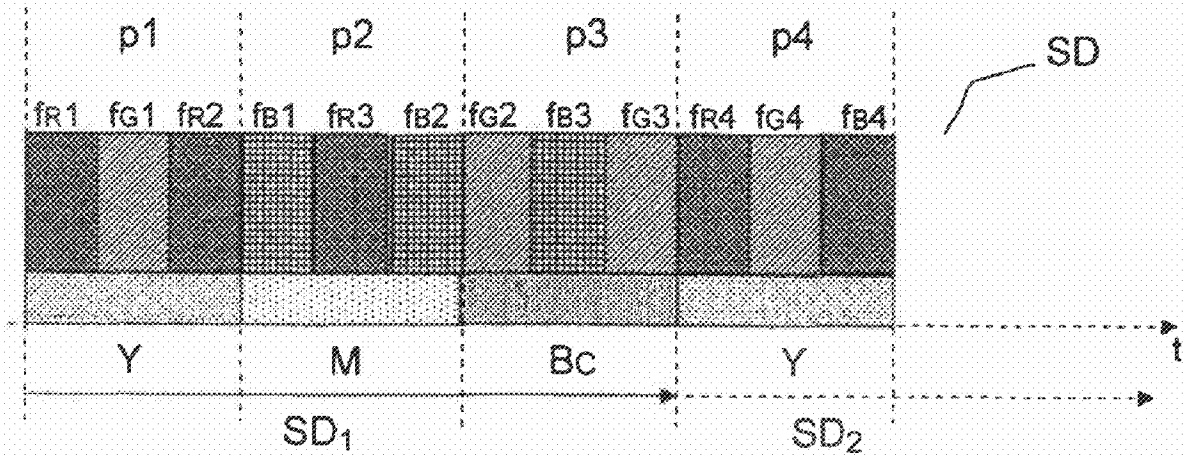
FIG. 5 illustrates a sequence of color frames according to a first embodiment of the invention.
Figure 6:
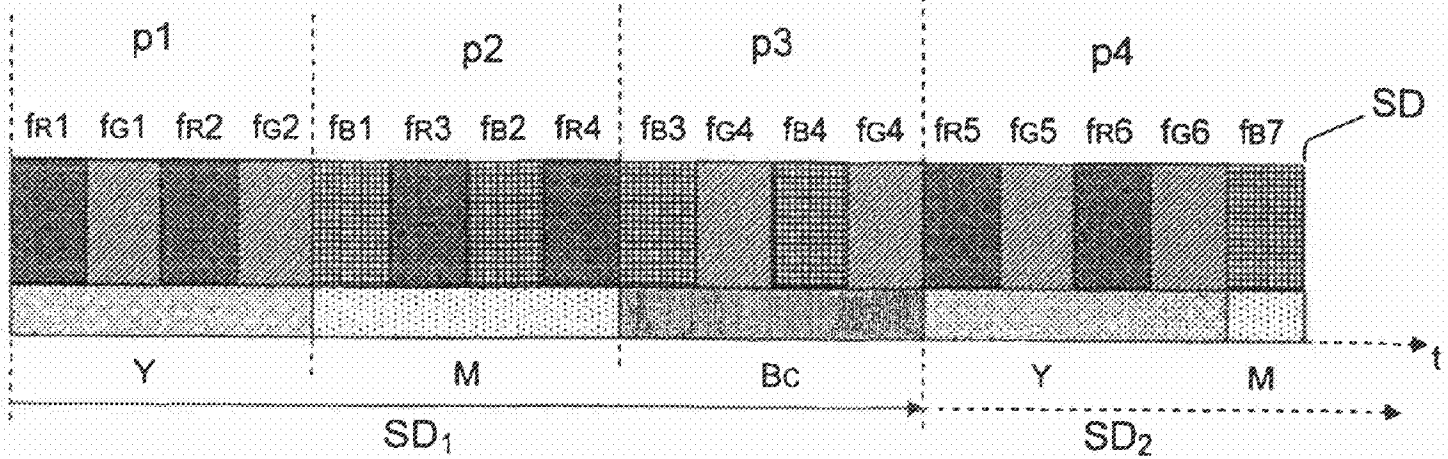
FIG. 6 illustrates a sequence of color frames according to a variant of the first embodiment.
Figure 7:
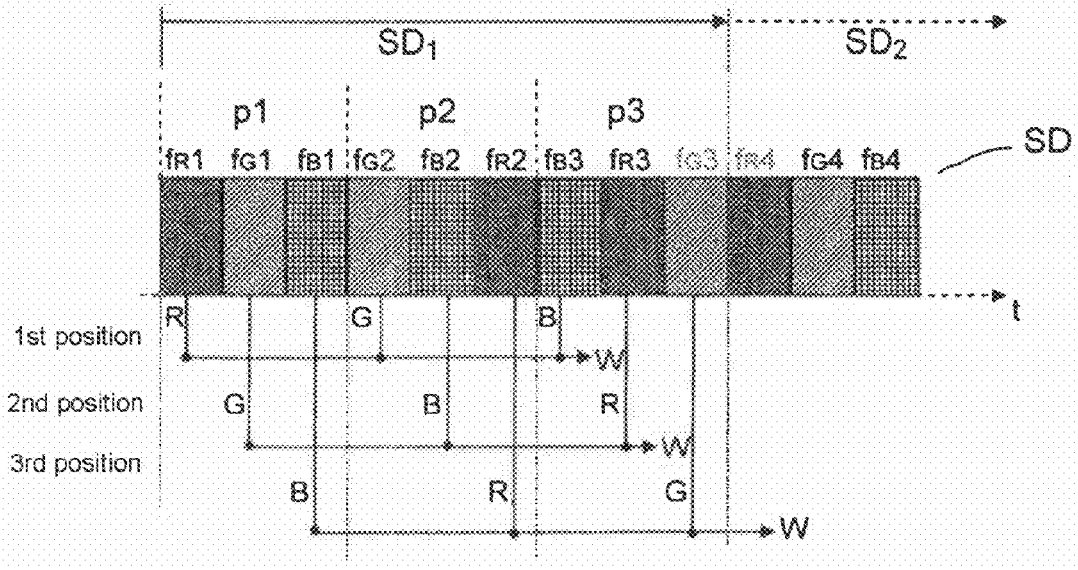
FIG. 7 illustrates a sequence of color frames according to a second embodiment of the invention.

FIGS. 5 to 7 illustrate examples of implementations of pseudo-random arrangements according to the invention in which a pseudo-random succession of the colors is obtained. These examples are not limiting.

Figure 1:
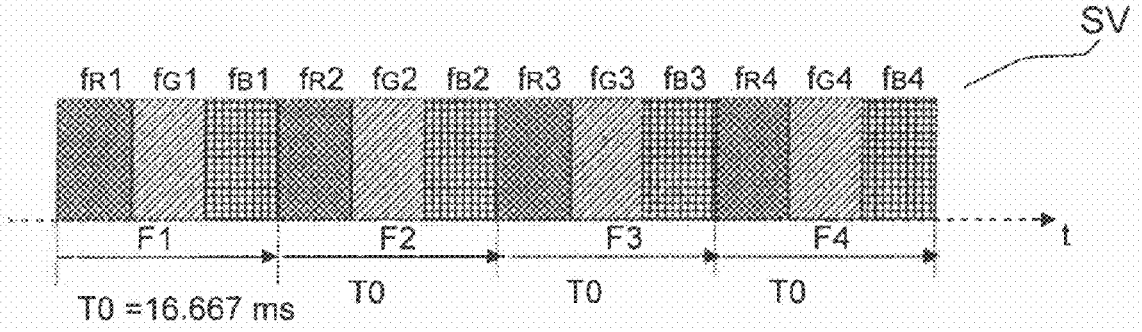
FIG. 1 already described illustrates a color sequence according to the prior art.
Figure 2:
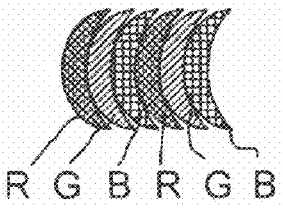
FIG. 2 already described illustrates the color-chopping phenomenon as perceived by the eye of an observer.

In these figures, the display sequences SD given as examples are formed from the input video sequence SV illustrated in FIGS. 1 and 4.

In the implementations of FIGS. 5 and 6, the display sequence SD of color frames according to the invention is formed in such a way that the color break-ups advantageously occur in the secondary colors yellow Y (green+yellow), magenta red M (blue+red), or cyan blue Bc (blue+green). These break-ups in the secondary colors are less perceptible to the eye of an observer than the break-ups of primary colors.

FIG. 5 illustrates a first corresponding embodiment. The display sequence SD is formed of a sequence of packets of n=3 color frames, each packet being associated with a pair of primary colors comprising a first primary color and a secondary primary color. In the packet considered, the odd-numbered color frames, typically those numbered 1 and 3 (n=3), are color frames corresponding to the first primary color and the even-numbered color frames, typically those numbered 2 (n=3), are color frames corresponding to the second primary color.

FIG. 6 illustrates a variant of this embodiment in which the packets comprise n=4 color frames: in a packet, the odd-numbered frames 1 and 3 are associated with the first primary color and the even-numbered color frames 2 and 4 are associated with the second primary color.

In this embodiment (FIGS. 5 and 6), two successive packets are associated with a different pair of primary colors.

Advantageously, the color of the color frame numbered n of a packet of the display sequence SD and the color of the color frame numbered 1 of the next packet of said sequence are different.

In practice, and as illustrated in FIG. 5, a corresponding display sequence SD may comprise a succession of subsequences $SD_1$, $SD_2$ of the same length, according to the same random pattern, each subsequence being generated from k=3 successive video frames F1 to Fk of the input video sequence SV, in the example from the three successive video frames F1 to F3 of FIGS. 1 and 4. In this example, each subsequence comprises three packets of n=3 frames. To form the first packet p1, a succession of three color frames is selected on the basis of a pair of first and second primary colors chosen from six possible pairs (R,G), (G,R), (G,B), (B,G), (R,B) or (B,R). In the example, the pair (R,G) is associated with the packet p1, the first color R of the pair giving the color of the first and of the third of the three color frames of the packet p1, and the second color G giving the color of the second color frame of the packet. The means 11 (FIG. 4) will then select the corresponding color frames in the video sequence SV, according to their chronological order of appearance and according to the colors sought, which gives, in the example for the packet p1, for the first color frame, $f_R$1, for the second color frame, $f_G$1, and for the third color frame, $f_R$2. The subsequent packets p2, p3 of the subsequence are formed according to the same principle: in the example, the second packet p2 corresponds to the selection of the pair of primary colors (B,R) and is formed with the frames $f_B$1, $f_R$3 and $f_B$2 of the sequence SV, associated with this color selection. The third packet p3 corresponds to the selection of the pair of primary colors (G,B) and is formed with the frames $f_G$2, $f_B$3 and $f_G$3 of the sequence SV, associated with this color selection.

The succession of colors imposed by the selection of the pairs (R,G) for p1, (B,R) for p2 and (G,B) for p3 give the random pattern of the subsequence $SD_1$: RGRBRBGBG. This pattern is repeated for each subsequence $SD_j$ as illustrated in FIG. 5 for the sequence $SD_2$.

Taking the example of FIG. 6, in which the packets of the color sequence each comprise n=4 color frames, the random pattern formed in the example is as follows: RGRGBRBRBGBG. A corresponding display sequence SD may be formed from the 12 color frames of k=4 successive video frames F1 to Fk, in the example (FIG. 4) based on the color frames from F1 to F4.

The embodiment of the invention that has just been described with reference to FIGS. 5 and 6 has the advantage of allowing a simple practical implementation requiring limited memory means.

FIG. 7 illustrates another embodiment of a display sequence SD according to the invention based on the input video sequence SV. This embodiment advantageously uses the spatial periodicity of the primary-color break-up phenomenon in order to remove it. An order of magnitude of the spatial periodicity to be used is a 10th, 100th of millimeters or centimeters.

According to this principle, and as illustrated, in a succession of three packets p1, p2, p3 and three color frames of the display sequence SD formed, the color frames are arranged so that, during the time of the color frame in the first position in each packet p1, p2, p3, there is red for one frame, green for another and blue for another, that is overall a white W. This is reproduced for each color frame position of the packets, that is to say the second positions and third positions. This removes the effect of spatial periodicity of the colors. In the example illustrated, this gives in first positions successively red, green and blue, in second positions, green, blue and red and in third positions, blue, red and green.

For reasons of simplicity of implementation that have already been mentioned, the display sequence SD may advantageously be formed by repetition of a random pattern, which in this instance is given by the succession of the colors on the sequence of the three successive packets p1 to p3, namely: RGBGBRBRG. This random pattern is then repeated from one subsequence to the other; $SD_1$, $SD_2$, etc. Each display subsequence may advantageously be formed from color frames of three complete successive video frames of the video sequence SV, such as F1, F2, F3.

When the sequence SD is thus formed by periodic repetition of a random pattern, for example all the nine color frames (FIGS. 5 and 7) or all the 12 color frames (FIG. 6), a requirement on the frequency of repetition of the random pattern must be applied, in order to prevent "flicker" effects: the frequency of repetition of the random pattern must be greater than the frequency for which this flicker appears, the frequency that is marked $f_{flicker}$.

According to another aspect of the invention, an arrangement of the display sequence SD from the video sequence SV according to the invention comprises an allocation of a random duration (frame time) to each of the color frames of the sequence. In this case, provision is made to take account of the following requirements:

the minimum duration $T_{min}$ for the display of a color frame, allowing the stabilization of the liquid crystal and the charging of the pixels of the active matrix of the display;

the maximum duration $T_{max}$ for the display of a color frame, beyond which the color frame will be perceived by the observer, which is to be avoided.

The characteristic times associated with the color frames (FIGS. 3 and 4) are marked tin, i=1 to 3 and n=r,g,b: so t1*r*, t2*r*, t3*r* are the characteristic times (frame times) allocated to the red color frames $f_R$1, $f_R$2 and $f_R$3; t1*g*, t2*g*, t3*g* are those allocated to the green color frames $f_G$1, $f_G$2 and $f_G$3; and t1*b* t2*b* t3*b* are those allocated to the blue color frames $f_B$1, $f_B$2, $f_B$3.

Take the example of a display sequence formed by repetition of a random pattern, for example a random pattern on nine color frames.

If, for any tin allocated to a color frame, i=1 to 3, n=r,g,b, $T_{min} \leqq tin \leqq T_{max}$ is verified, the user is sure to have an optimum time for the display of the frame.

If the characteristic times tin are chosen such that their sums in each color for the duration of the random pattern are equal, that is in the example if t1*r*+t2*r*+t3*r*=t1*b*+t2*b*+t3*b*=t1*g*+t2*g*+t3*g*, then it will give a good balance of the colors, with balanced systems of illumination of the three primary colors: for an illumination time that is identical in each color, this will give an achromatic white for each subsequence repeating the random pattern.

Finally, in order that an observer does not perceive the flicker effect of the color frames on the display, the characteristic times tin for the duration of the random pattern are preferably chosen so that $$\sum_{i=1}^{3} \sum_{n=r,g,b} tin \leq T_{flicker}$$

is verified, where $T_{flicker}$ is equal to the inverse of the flicker frequency.

If all these requirements are observed, the color frames may be chained in a completely random manner in the display sequence SD.

If the emitted light is emitted by the lightbox for a color frame only for a fraction of the frame time allocated to this color frame, the aforementioned requirements are written slightly differently for the balance of the colors. Notably this is the case in displays the addressing method of which is based on a division of the characteristic time of each color frame into three periods:

| Color frame characteristic time | Pixel writing | Liquid crystal stabilization | Display |
|---|---|---|---|
| State of the lightbox | Off | Off | On |

In this case, in the equation on the aforementioned characteristic times which makes it possible to obtain an equal balance of colors, it is necessary to take account of the real time allocated in each color frame to the illumination of the matrix. If $t_a$in is the time of illumination of the lightbox on the frame time tin associated with a color frame, this equation becomes: $t_a$1*r*+$t_a$2*r*+$t_a$3*r*=$t_a$1*g*+$t_a$2*g*+$t_a$3*g*=$t_a$1*b*+$t_a$2*b*+$t_a$3*b*.

An addressing method according to the invention that has just been explained and implementation examples of which have been given with respect to FIGS. 1 to 7 therefore makes it possible, by acting on the succession of the colors of the frames and/or their display duration, and optionally on the lighting power emitted by the lightbox of the display, to make the color break-up imperceptible or virtually imperceptible.

Figure 8:
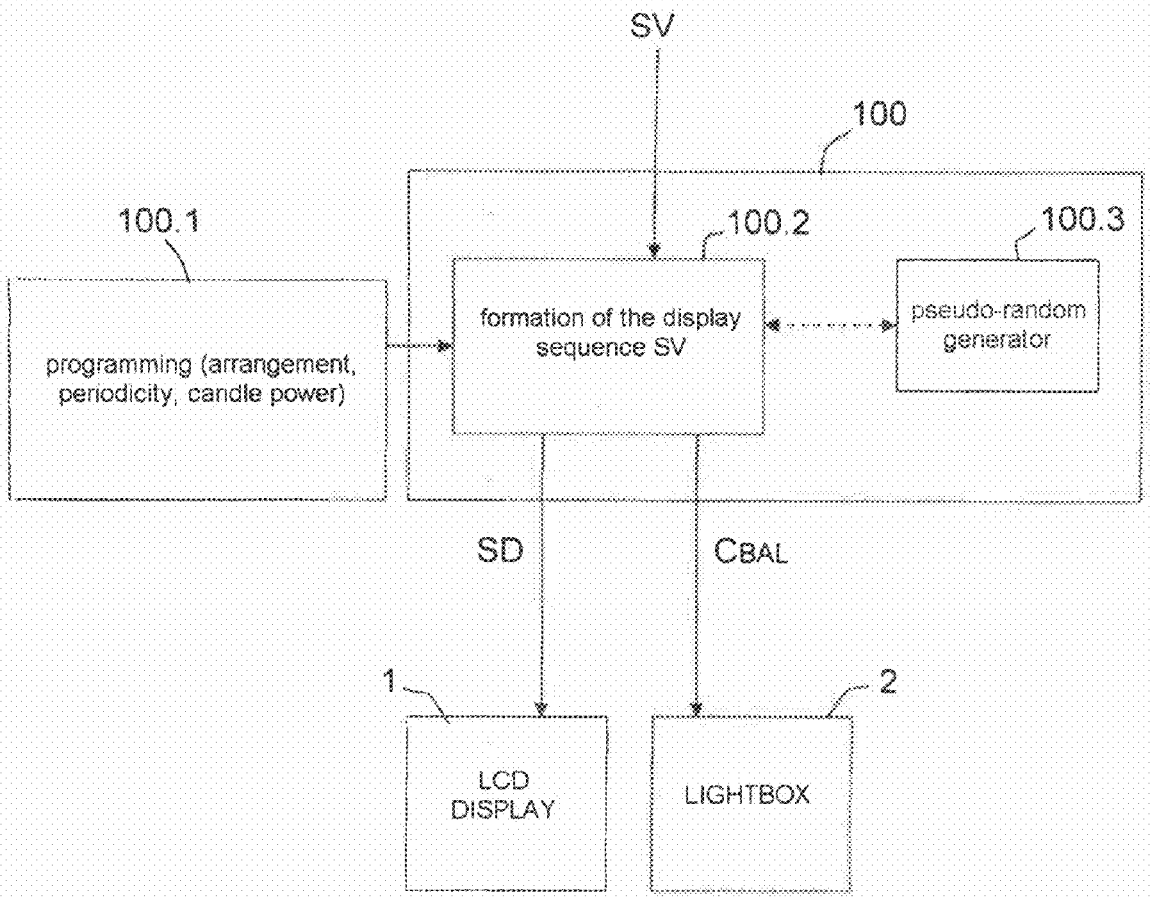
FIG. 8 is a general block diagram of a method for addressing an LCD display according to the invention.

FIG. 8 gives a general impression of an addressing method with an arrangement step 100 of the color frames according to the invention: after a programming 100.1 of the formation of the display sequence (type of arrangement (random succession of the colors and/or random display duration), periodicity of a random pattern, random lighting power), the color frames of the video sequence SV received at the input are rearranged in a step 100.2 for forming the display sequence SD, according to these chosen implementation options, and the imposed requirements: a display sequence SV is formed in a step 100.2, if necessary with the assistance 100.3 of a pseudo-random generator in order to supply characteristic times of the color frames: frequency of repetition of a random pattern, minimum and maximum duration values, color balance. This then gives at the output a display sequence SD which is applied to the LCD display 1, associated with a control method $C_{BAL}$ corresponding to the lightbox 2: succession of colors, illumination duration, lighting power.

The invention that has just been described by means of a few nonlimiting examples makes it possible to improve the display quality of the liquid crystal displays of the color sequential addressing type, and can be applied to the whole range of direct view screens.

It will be readily seen by one of ordinary skill in the art that the present invention fulfils all of the objects set forth above. After reading the foregoing specification, one of ordinary skill in the art will be able to affect various changes, substitutions of equivalents and various aspects of the invention as broadly disclosed herein. It is therefore intended that the protection granted hereon be limited only by the definition contained in the appended claims and equivalent thereof.

The invention claimed is:

1. A method for addressing a color sequential liquid crystal display, based on a video sequence made of a sequence of a plurality of video frames, each video frame having a sequence of three successive color frames corresponding to three primary colors, the method comprising:

randomly or pseudo-randomly arranging the color frames of the video sequence to provide a display sequence of color frames to be applied to the display, wherein said random or pseudo-random arranging includes forming a succession of packets of n color frames, n being an integer at least equal to 3, each packet of n color frames is associated with a pair of primary colors, including a first primary color and a second primary color, the pair of primary colors being randomly or pseudo-randomly chosen among six possible pairs of primary colors that can be formed with the three primary colors, and each packet of n color frames is formed by selecting n colored frames in the succession of colored frames of the video sequence as a function of the first and second primary colors associated to said packet, such that odd-numbered color frames in said packet are color frames corresponding to the first primary color and even-numbered color frames in the packet are color frames corresponding to the second primary color.

2. The method for addressing the color sequential liquid crystal display as claimed in claim 1, wherein the random arranging includes a random or pseudo-random allocation of duration of each of the color frames.

3. The method for addressing the color sequential liquid crystal display as claimed in claim 2, wherein a level of light power of each color frame is such that lighting power reconstituted on the display corresponds to an achromatic white.

4. The addressing method as claimed in claim 2, wherein the duration of each color frame is chosen randomly in a range of values lying between a minimum value corresponding to a minimum stabilization time for the liquid crystal and a predetermined maximum value.

5. The addressing method as claimed in claim 4, wherein a sum of durations of the color frames in each primary color of a sequence of three successive packets is equal for each of the primary colors.

6. The addressing method as claimed in claim 4, wherein a sum of durations of illumination of the display in each primary color of a sequence of three successive packets is equal for each of the primary colors.

7. The addressing method as claimed in claim 4, wherein durations of the color frames are such that, on a periodic sequence of three successive packets, a total sum of the durations of the color frames is less than or equal to a predetermined duration corresponding to the inverse of a flicker frequency.

8. The method for addressing the color sequential liquid crystal display as claimed in claim 1, wherein each color frame includes a phase for illuminating the display by a lightbox in a corresponding primary color, and a level of lighting power emitted by the lightbox in the illumination phase associated with each of the color frames of the display sequence is random or pseudo-random.

9. The addressing method as claimed in claim 1, wherein the nth color frame of a packet of the display sequence and the first color frame of the next packet of the sequence are associated with different primary colors.

10. The addressing method as claimed in claim 1, wherein n equals 3 or 4.

11. The addressing method as claimed in claim 1, wherein the random arranging includes periodic repetition of a random pattern.

12. The addressing method as claimed in claim 11, wherein the periodicity of the random pattern is such that a sum of color frame time durations of the random pattern is less than or equal to the inverse of a flicker frequency.

13. A liquid crystal display of a color sequential addressing type, comprising:

an addressing device that addresses the liquid crystal display based on a video sequence made of a sequence of a plurality of video frames, each video frame having a sequence of three successive color frames corresponding to three primary colors, the addressing device randomly or pseudo-randomly arranging the color frames of the video sequence to provide a display sequence of color frames to be applied to the display, wherein said random or pseudo-random arranging includes forming a succession of packets of n color frames, n being an integer at least equal to 3, each packet of n color frames is associated with a pair of primary colors, including a first primary color and a second primary color, the pair of primary colors being randomly or pseudo-randomly chosen among six possible pairs of primary colors that can be formed with the three primary colors, and each packet of n color frames is formed by selecting n colored frames in the succession of colored frames of the video sequence as a function of the first and second primary colors associated to said packet, such that odd-numbered color frames in said packet are color frames corresponding to the first primary color and even-numbered color frames in the packet are color frames corresponding to the second primary color.

* * * * *